US009984834B2

(12) United States Patent
Hu et al.

(10) Patent No.: US 9,984,834 B2
(45) Date of Patent: May 29, 2018

(54) KEYCAP AND MANUFACTURING METHOD THEREOF

(71) Applicant: Darfon Electronics Corp., Taoyuan County (TW)

(72) Inventors: Tsai-Jung Hu, Taoyuan County (TW); Shih-Kai Chen, Taoyuan County (TW)

(73) Assignee: DARFON ELECTRONICS CORP., Taoyuan County (TW)

( * ) Notice: Subject to any disclaimer, the term of this patent is extended or adjusted under 35 U.S.C. 154(b) by 171 days.

(21) Appl. No.: 14/701,619

(22) Filed: May 1, 2015

(65) Prior Publication Data

US 2015/0318125 A1 Nov. 5, 2015

(30) Foreign Application Priority Data

May 2, 2014 (TW) ..... 103115892 A

(51) Int. Cl.
*H01H 11/00* (2006.01)
*H01H 13/04* (2006.01)
*H01H 13/88* (2006.01)

(52) U.S. Cl.
CPC ..... *H01H 11/00* (2013.01); *H01H 13/04* (2013.01); *H01H 13/88* (2013.01); *H01H 2219/028* (2013.01); *H01H 2223/044* (2013.01); *H01H 2229/022* (2013.01); *Y10T 29/4989* (2015.01)

(58) Field of Classification Search
CPC ..... H01H 11/00; H01H 13/04; H01H 13/88; H01H 2219/028; H01H 2223/044; H01H 2229/022; Y10T 29/4989
USPC ..... 200/5 A, 304
See application file for complete search history.

(56) References Cited

U.S. PATENT DOCUMENTS 5,807,002 A * 9/1998 Tsai ..... H01H 13/705 200/311
2011/0076455 A1* 3/2011 Lee ..... B29C 45/1671 428/161
2013/0248337 A1* 9/2013 Hu ..... H01H 9/02 200/304

FOREIGN PATENT DOCUMENTS

| | | |
|---|---|---|
| CN | 1897189 A | 7/2007 |
| CN | 102629527 | 8/2012 |
| CN | 103187196 | 7/2013 |
| TW | 201307097 A | 2/2013 |
| TW | 201316366 A | 4/2013 |
| TW | 201338958 A | 10/2013 |

* cited by examiner

*Primary Examiner* — Edwin A. Leon
*Assistant Examiner* — Iman Malakooti
(74) *Attorney, Agent, or Firm* — McClure, Qualey & Rodack, LLP

(57) ABSTRACT

A method of manufacturing keycaps, each keycap having a top and a skirt, includes: providing a first jig having a plurality of positioning units; arranging correspondingly a plurality of keycaps onto the plurality of positioning units; attaching a first film including an ink layer and a first release layer to the plurality of keycaps by using an out-mold transfer technique, such that the first film covers respective upper surfaces of the tops and respective side surfaces of the skirts of keycaps; removing the first release film; laser-engraving the ink layer; and forming a protection layer on the laser-engraved ink layer. A keycap manufactured by the method of the present invention is also disclosed.

10 Claims, 16 Drawing Sheets

KEYCAP AND MANUFACTURING METHOD THEREOF

BACKGROUND OF THE INVENTION

1. Field of the Invention

The present invention generally relates to a keycap and a manufacturing method thereof. Particularly, the present invention relates to a patterned keycap having a selective protection layer and a manufacturing method thereof.

2. Description of the Prior Art

Keyboard is one of the important input devices for electronic devices, such as computer or mobile phone, while keyswitches are the most important parts constructing the keyboard. The keycap is the upmost part of the keyswitch and is generally manufactured by the injection molding technique. Firstly, the keycaps are formed corresponding to the keyswitches of a keyboard product and then engraved or printed with symbols or characters on the surface of each keycap. Finally, the keycaps are arranged on the substrate of the keyboard.

For the process of forming the symbol or character on the surface of the keycap, the conventional technique sequentially prints or sprays one or multiple layers of ink on the top face of the keycap and then forms the symbol or character by laser etching the ink layer(s). Finally, a protection layer is sprayed or printed to cover the ink layer(s) and a hardening treatment is performed on the protection layer. Such a forming process is time-consuming. Especially when multiple layers of ink are employed, the process variation is increased, decreasing the product yield of the keycaps.

In addition, if the protection layer is formed by spray coating, the protection layer will cover all exposed portions of the keycap, resulting in waste and non-uniform thickness of the protection layer caused by the spraying angle. If the protection layer is formed by the printing technique, the protection layer will cover only the top face of the keycap and cannot extend to the side face of the keycap (i.e. skirt of the keycap), making the user feel uneven touch during operation and affecting the input smoothness. Consequently, the spray coating or the printing technique cannot form a selective protection layer.

Taiwan patent publication no. 201338958 discloses a keycap having a layered ink structure formed by the in-mold release (IMR) technique. The IMR technique can greatly reduce the time for covering the layered ink structure onto the keycap and effectively improve the connection between the layered ink structure and the keycap to prevent the layered ink structure from peeling off. However, the protection layer cannot be formed by the IMR technique, and the keyboard usually includes multiple keycaps of different sizes which cannot be formed by injection molding in the same mold. That is, the keycaps of different sizes cannot be formed by the injection molding at the same time. Moreover, due to the restriction of the IMR technique, the gap between the cavities for accommodating the keycaps must be large enough, reducing the number of keycaps of the same size that can be processed by one mold, thus requiring more films and increasing the cost.

Moreover, for the IMR technique, the process involves the steps of releasing the upper mold and the bottom mold; thus the bottom face of the skirt cannot be covered (i.e. barb-like covering). The film (including the ink layer and the release layer) will generally create a parting line at the lower edge of the skirt; thus part of the ink layer will be likely removed during the removal of the release layer of the film. Consequently, the ink layer on the lower edge of the skirt will exhibit a zigzag or irregular shape, resulting in severe light leakage of the lighting keyboard.

Therefore, a method of manufacturing keycaps to solve the aforesaid problems and to achieve mass production of keycaps with user satisfaction is desired.

SUMMARY OF THE INVENTION

In view of the prior arts, it is an object of the present invention to provide a method of manufacturing keycaps, wherein the surface of the keycap can be selectively covered; in comparison with the prior arts, the method of the present invention has the advantages of reduced production time, lower cost, less contaminants. The keycaps manufactured by the method of the present invention can bring a smooth touch to the user without causing the light leakage that is commonly occurred in the lighting keyboard.

In an embodiment, a method of manufacturing keycaps includes (a) providing a first jig having a plurality of positioning units respectively corresponding to a plurality of keycaps, each keycap having a top and a skirt connected to at least a portion of periphery of the top, the skirt having a side face and defining, together with the top, a space of the keycap; (b) arranging the plurality of keycaps onto the plurality of positioning units, respectively; (c) attaching a first film including an ink layer and a first release layer onto the plurality of keycaps by an out-mold transfer technique in a manner that the first film covers surfaces of the tops of the plurality of keycaps and the side faces of the skirts of the plurality of keycaps; (d) removing the first release layer to expose the ink layer on the plurality of keycaps; (e) patterning the ink layer to form corresponding characters or symbols on the plurality of keycaps; and (f) forming a protection layer on the patterned ink layer to protect the characters or symbols formed on the plurality of keycaps.

In another embodiment, each keycap further includes an engaging portion for engaging the keycap onto the corresponding positioning unit. The method further includes (g1) providing a second jig including a receiving part and a pushing part, the receiving part including a plurality of first receiving spaces respectively corresponding to the plurality of positioning units; (g2) aligning the tops of the plurality of keycaps with the plurality of receiving spaces, respectively; and (g3) by means of the pushing part, removing the plurality of keycaps from the plurality of positioning units to position the plurality of keycaps respectively in the first receiving spaces and expose the engaging portions of the plurality of keycaps.

In another embodiment, the method further includes (f1) providing a third jig including a plurality of second receiving spaces respectively corresponding to the plurality of positioning units, the third jig having a predetermined thickness less than the height of the skirt; (f2) disposing the third jig on the first jig to mask a portion of the side face of the skirt of each keycap; (f3) attaching a second film including the protection layer and a second release layer onto the plurality of keycaps by the out-mold transfer technique in a manner that the second film covers surfaces of the tops and a portion of the side faces of the skirts of the plurality of keycaps not masked by the third jig; and (f4) removing the second release layer to expose the protection layer on the plurality of the keycaps.

In an embodiment, the step (c) further includes (c1) adjusting a difference in gas pressure above a top surface and below a bottom surface of the first film. In an embodiment, each of the plurality of positioning units of the first jig has a through hole, and the step (c1) includes (c11) providing a pumping jig including a plurality of gas holes, the pumping jig drawing gas through the gas holes; and (c12) disposing the first jig on the pumping jig to simultaneously draw gas through the through holes from the spaces of the keycaps to reduce the gas pressure under the first film.

In an embodiment, the step (c) further includes (c2) increasing the gas pressure above the first film to create a difference in pressure above and below the first film to make the first film cover the surfaces of the tops and the side faces of the skirts of the plurality of keycaps.

In an embodiment, the skirt of each keycap has a bottom face; when the plurality of keycaps are disposed on the plurality of positioning units of the first jig, the bottom faces are exposed and the first film covers the bottom faces of the skirts. In an embodiment, the number of the plurality of positioning units of the first jig corresponds to the number of keyswitches of a keyboard product; the keyboard product can be independently sold or mounted on an electronic device.

In an embodiment, a space exits between adjacent positioning units; the space is equal to a space between adjacent keyswitches of a keyboard product; the keyboard product can be independently sold or mounted on an electronic device.

Another object of the present invention is to provide a keycap, which is manufactured by the method of the present invention. In an embodiment, the keycap includes a top having an upper surface; a skirt surroundingly connected to at least a portion of periphery of the top, the skirt having a side face; an ink layer for forming character or symbol, the ink layer including an upper ink portion on the upper surface of the top and a side ink portion on the side face of the skirt, the side ink portion including an upper section and a lower section; and a protection layer formed on the upper ink portion and the upper section of the side ink portion to expose the lower section of the side ink portion.

In another embodiment, a keycap includes a top having an upper surface; a skirt surroundingly connected to at least a portion of periphery of the top, the skirt having a side face including an upper portion and a lower portion; an ink layer for forming character or symbol, the ink layer including an upper ink portion on the upper surface of the top and a side ink portion on the upper portion of the side face of the skirt; and a protection layer formed on the upper ink portion and the side ink portion to expose the lower portion of the side face.

In yet another embodiment, a keycap includes a top having an upper surface; a skirt surroundingly connected to at least a portion of periphery of the top, the skirt having a side face and a bottom face; an ink layer formed on the upper surface of the top and the side face and the bottom face of the skirt; and a protection layer formed on the ink layer.

In other embodiments, the protection layer can have a convex-concave texture, a nanostructure, an optical structure, or a structure enabling the protection layer with hydrophobic property. The protection layer having aforesaid specific structure can be formed on the keycaps by the out-mold transfer technique.

In an embodiment, the side face of the skirt is a quadrilateral; the boundary of the upper section and the lower section of the side ink portion is substantially a straight line extending horizontally. In another embodiment, the side face and the bottom face of the skirt are both quadrilateral.

In comparison with the prior arts, the method of the present invention is an eco-economic process, which processes all keycaps of one keyboard at one time and reduces the use of spray coating process to reduce environmental pollution, and has the advantages of selectively covering the keycap as desired and cost-reduction. The keycap manufactured by the method of the present invention can provide the user with a continuous, smooth touch and effectively prevents the light leakage for the lighting keyboard.

The advantages and spirit of the invention can be further understood in view of the detailed descriptions and the accompanying drawings.

DETAILED DESCRIPTION OF THE PREFERRED EMBODIMENT

According to an embodiment of the present invention, a keycap and a manufacturing method thereof are provided, wherein the method can manufacture a plurality of keycaps for corresponding keyswitches of a keyboard product in a batch so as to simplify the manufacturing procedure and cost. The keyboard product can be a commercial keyboard or a keyboard module to be mounted on an electronic device.

Figure 1A:
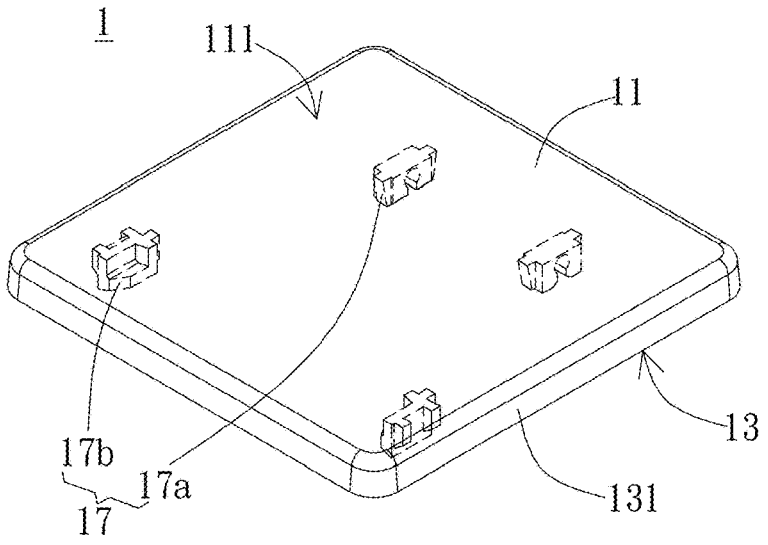
FIGS. 1A and 1B are respectively a top view and a bottom view of a keycap in an embodiment of the invention.
Figure 1B:
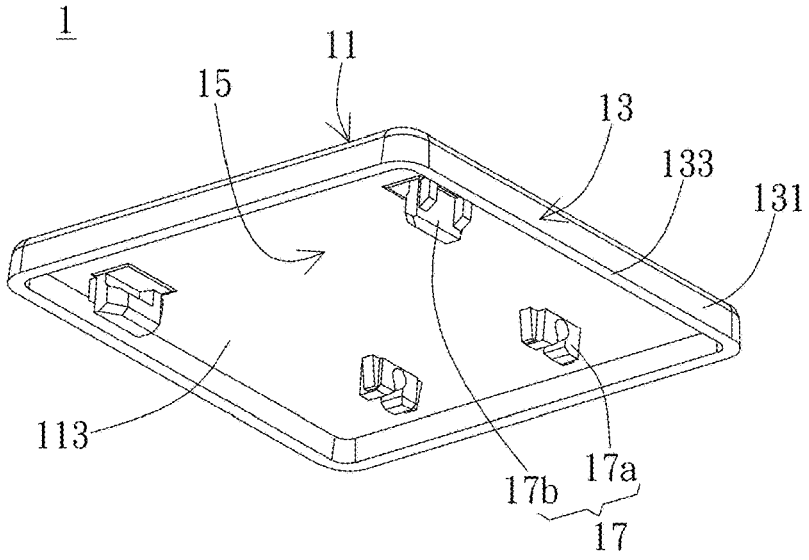

In the invention, as shown in FIGS. 1A and 1B, the keycap 1 formed by injection molding includes a top 11 and a skirt 13, wherein the top 11 has an upper surface 111 and a lower surface 113. The skirt 13 is surroundingly connected to at least a portion of periphery of the top 11 and includes a side face 131 and a bottom face 133. The top 11 and the skirt 13 together define a space 15 under the keycap 1. In the invention, the top 11 is preferably a quadrilateral, but not limited thereto. It is noted that the quadrilateral top 11 of FIG. 1A is an exemplarily embodiment, the top of the keycap can have other regular or irregular shapes, such as a round shape. The shape of the skirt corresponds to the shape of the top and extends downward at a substantial right angle or a predetermined angle with respect to the upper surface of the top. Moreover, the side face 131 and the bottom face 133 of the skirt are also quadrilateral, but not limited thereto. It is noted that the side face and the bottom face of the skirt can be quadrilateral or other shapes, such as a curve shape, according to different design needs.

As shown in FIG. 1B, the keycap 1 further has at least one engaging portion 17 for coupling the up-down mechanism (not shown) of the keyswitch. Taking the scissor-like up-down mechanism as an example, the engaging portion 17 of the keycap 1 can include a first engaging portion 17*a* and a second engaging portion 17*b*, wherein the first engaging portion 17*a* and the second engaging portion 17*b* are disposed on the inner side of the keycap 1 and located in the space 15. In other words, the first engaging portion 17*a* and the second engaging portion 17*b* are disposed in pair on opposite sides and on the lower surface 113 of the top 11 and can be a pivot hole member and a slot member, respectively. After the keycap 1 and the up-down mechanism couple together, the keycap 1 can relatively rotate or slide. Hereinafter, the manufacturing method and the jigs used in the embodiment will be described in detail.

Figure 2A:
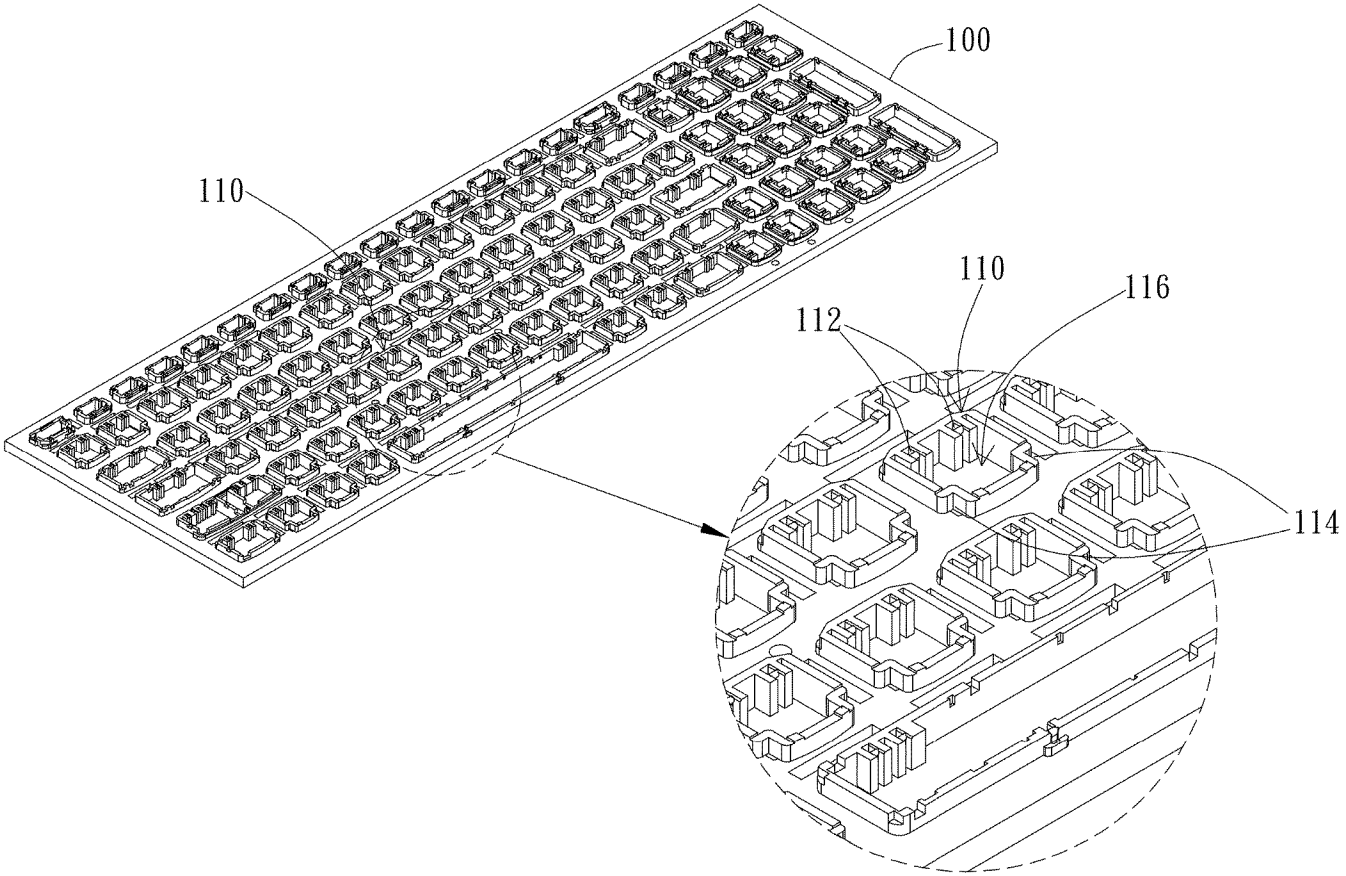
FIG. 2A is a schematic view of the first jig used in an embodiment of the invention.

In an embodiment, the manufacturing method includes: providing a first jig 100 (as shown in FIG. 2A), wherein the first jig 100 includes a plurality of positioning units 110. The plurality of positioning units 110 respectively correspond to the plurality of keycaps (such as the keycap 1 of FIG. 1A). In this embodiment, the first jig 100 is made of thermal resistant and pressure resistant materials, such as metal or alloy. Moreover, the number, location, size, shape of the plurality of positioning units 110 of the first jig 100 preferably correspond to the keyswitches of a keyboard product to be formed, so the plurality of positioning units 110 respectively correspond to the keycaps of the keyswitches. That is, the space between adjacent positioning units is substantially equal to the space between adjacent keyswitches of the keyboard product. For a keyboard having 108 keyswitches, the first jig 100 may have 108 positioning units 110, wherein the locations of the 108 positioning units respectively correspond to the locations of the 108 keyswitches of the keyboard product. Moreover, the 108 positioning units 110 may include various types of positioning units 110 with shape and size corresponding to the function keys, hot keys, space key, number/alphabet keys, etc.

Figure 2B:
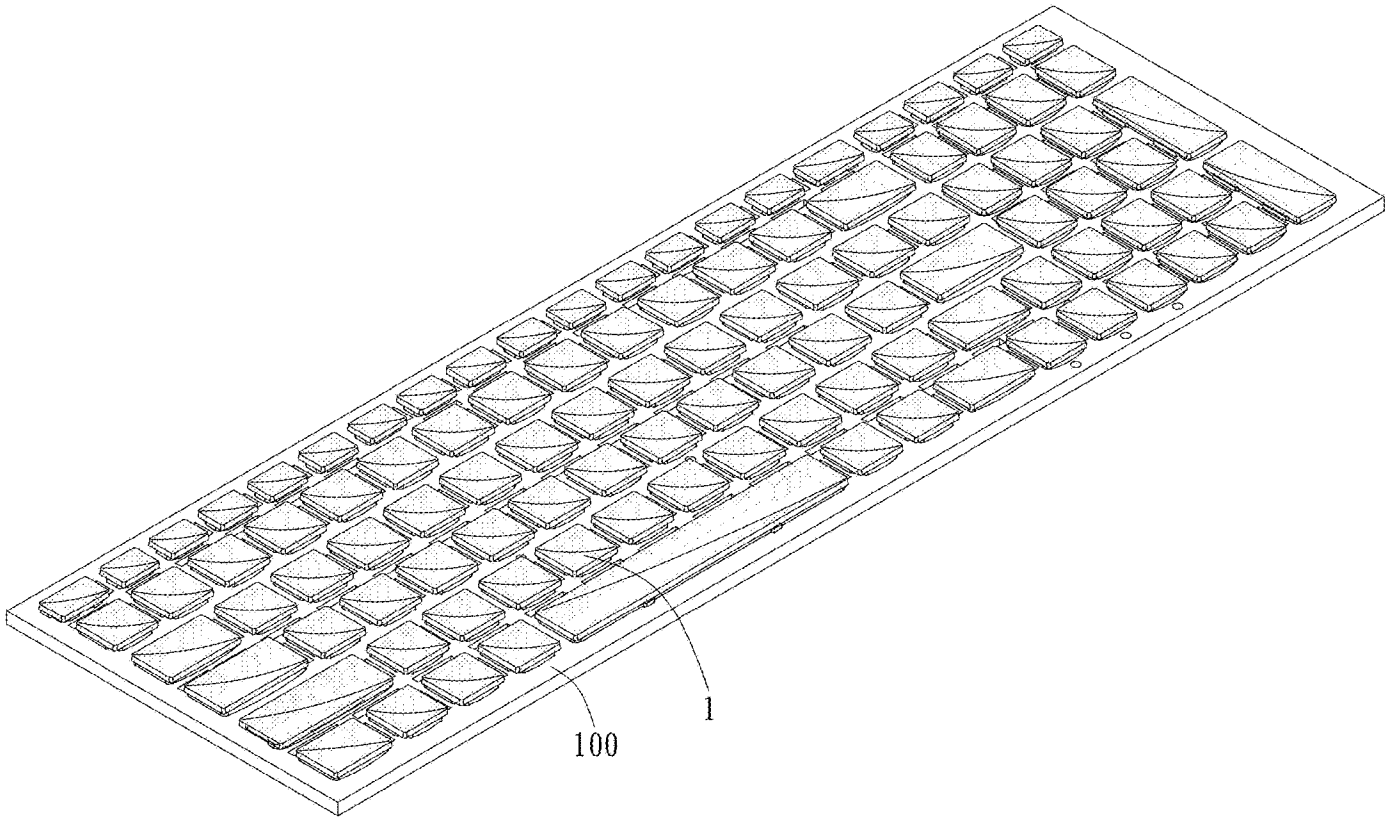
FIG. 2B is a schematic view of the plurality of keycaps arranged on the first jig in an embodiment of the invention.

The method further includes arranging the plurality of keycaps 1 onto the plurality of positioning units 110, respectively, as shown in FIG. 2B. That is, the plurality of keycaps 1 can be disposed on the plurality of positioning units 110 through their respective engaging portions 17. Particularly, as shown in FIG. 2A, each positioning unit 110 is a protruding structure that protrudes from the surface of the first jig 100 and has a first connection member 112 and a second connection member 114 for connecting the keycap 1. In this embodiment, the first connection member 112 and the second connection member 114 of the positioning unit 110 correspond to the first engaging portion 17*a* and the second engaging portion 17*b*, respectively. When the keycap 1 is disposed on the positioning unit 110, the first connection member 112 and the second connection member 114 will engage with the first engaging portion 17*a* and the second engaging portion 17*b*, respectively, to secure the keycap 1 onto the positioning unit 110. Consequently, the keycaps 1 will not fall off the positioning units 110 of the first jig 100 during subsequent processes, such as blowing/drawing gas for film-attaching process, transferring process, or flipping process. Corresponding to the first engaging portion 17*a* in the form of pivotal hole, the first connection member 112 includes a pivot shaft. Corresponding to the second engaging portion 17*b* in the form of sliding groove structure, the second connection member 114 includes an engaging groove. For example, the first engaging portion 17*a* in the form of pivot hole engages with the pivot shaft of the first connection member 112, and the sidewall at opposite end of the first connection member 112 is recessed inwardly to form the engaging groove as the second connection member 114, so that the second connection members 114 are disposed in pair and touch against the inner faces of the second engaging portions 17*b* pushing the second engaging portions 17*b* in the direction toward the skirt 13. As such, the plurality of keycaps 1 can be mounted onto the positioning units 110 of the first jig 100, respectively.

After that, the method further includes attaching a first film onto the plurality of keycaps 1 by an out-mold transfer technique in a manner that the first film covers the upper surfaces 111 of the tops 11 of the plurality of keycaps 1 and the side faces 131 of the skirts 13 of the plurality of keycaps 1, wherein the first film includes an ink layer and a first release layer (as described later).

The out-mold transfer technique refers to the out-mold release (OMR) of the out-mold decoration (OMD) technique, or so-called high pressure transfer, which adjusts parameters including temperature and pressure to soften the film and then the film is transferred onto or covers the object. In this embodiment, the method further includes adjusting the difference in gas pressure above the top surface and below the bottom surface of the first film, so that the first film can securely cover the upper surfaces 111 of the tops 11 of the plurality of keycaps 1 and the side faces 131 of the skirts 13 of the plurality of keycaps 1. For example, the difference in gas pressure above the top surface and below the bottom surface of the first film can be adjusted by increasing the gas pressure above the top surface of the first film to create a difference in pressure above and below the first film. In another embodiment, In addition to the introduction of high pressure gas over the first film, a vacuum process can be simultaneously performed below the bottom surface of the first film.

Figure 3A:
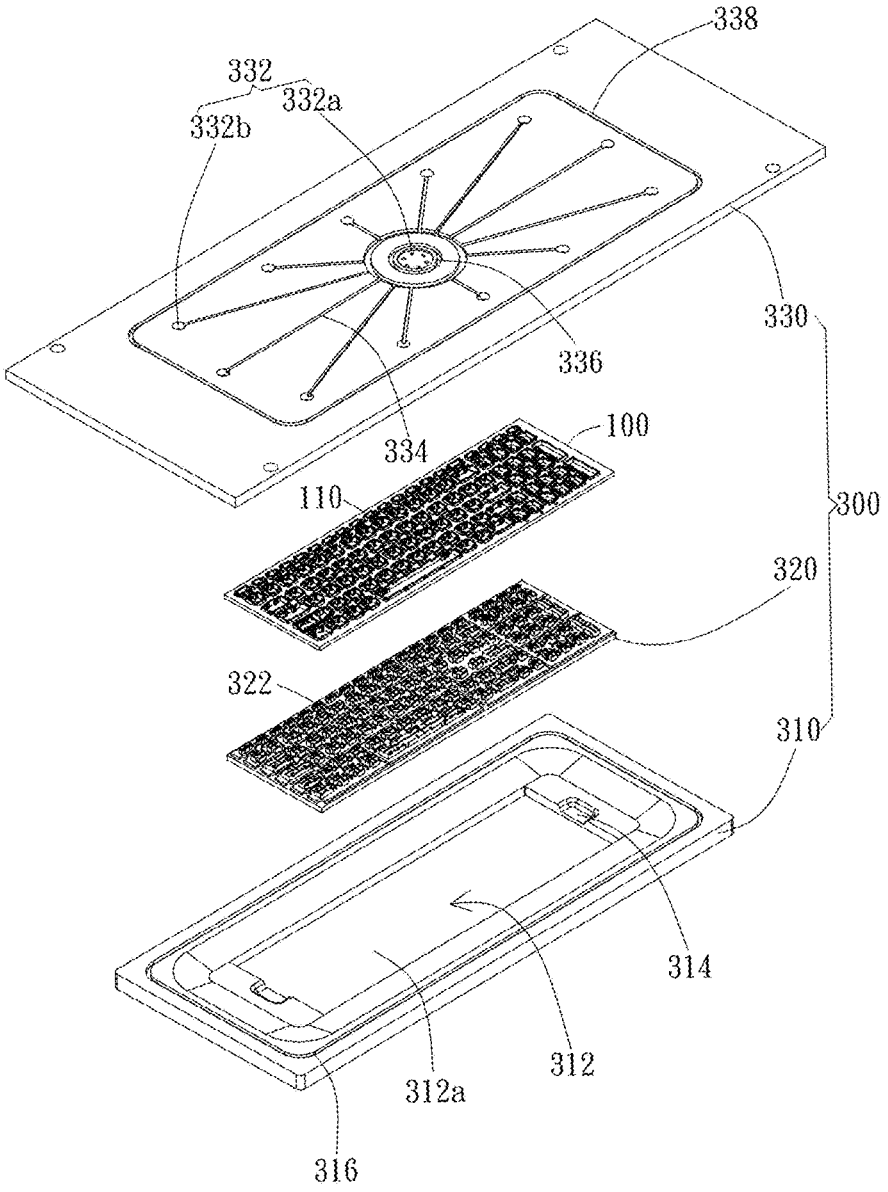
FIG. 3A is a schematic view of the first jig and the pumping jig used in an embodiment of the invention.

Specifically, as shown in FIG. 3A, the first jig 100 can work with a pumping jig 300 to achieve the out-mold transfer described above. In this embodiment, the pumping jig 300 includes a jig base 310, a jig body 320, and a jig cover 330, wherein the jig body 320 is disposed on the jig base 310. The first jig 100 is disposed on the jig body 320, and the jig cover 330 is disposed on the first jig 100 and connected to the jig base 310 to form a sealed structure. For example, the jig base 310 is a base having an accommodation space 312, wherein the jig body 320 is disposed in the accommodation space 312. In this embodiment, the jig base 310 is recessed from the surface to form the accommodation space 312, and an opening 312*a* corresponding in shape to the jig body 320 is formed in the accommodation space 312, so that the jig body 320 can be positioned in the accommodation space 312 by engaging its outer contour with the opening 312*a* of the jig base 310. The jig base 310 further has a notch 314, wherein the notch 314 is located at the recessed portion of the jig base 310 and near the opening 312*a* to facilitate the mounting/demounting of the jig body 320 and the first jig 100 to/from the jig base 310. The jig base 310 further has a seal ring groove 316 for increasing the airtightness of the pumping jig 300. In this embodiment, the seal ring groove 316 is disposed to surround the accommodation space 312.

Figure 3B:
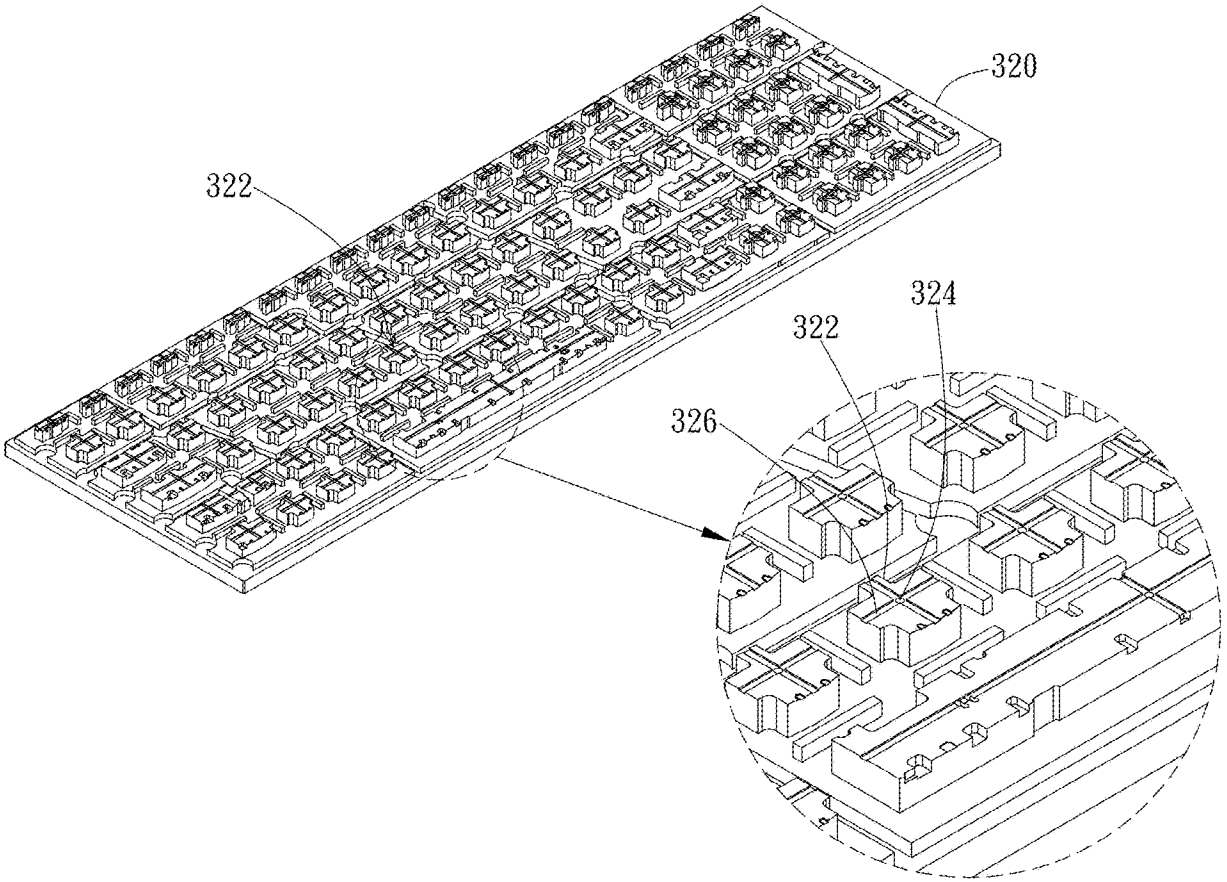
FIG. 3B is a schematic view of the jig body of the pumping jig of FIG. 3A.
Figure 3C:
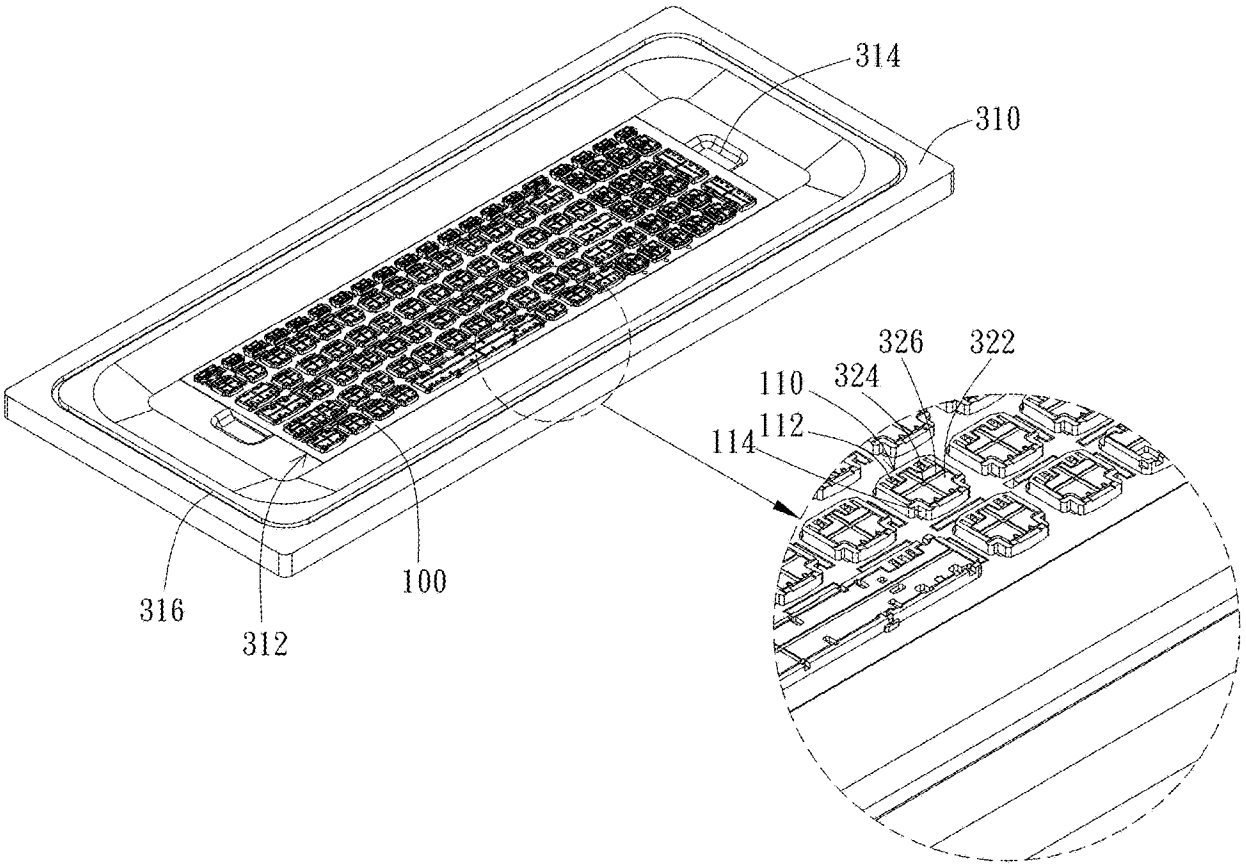
FIG. 3C is a schematic view of the first jig stacked on the jig body of the jig base of FIG. 3A.

As shown in FIG. 3B and FIG. 3C, The jig body 320 includes a plurality of pumping structures 322, wherein the plurality of pumping structures 322 correspond to the plurality of positioning units 110 of the first jig 100, respectively. Particularly, each of the positioning units 110 of the first jig 100 has a through hole 116 (as shown in FIG. 2A); each pumping structure 322 corresponds in shape to the through hole 116. When the first jig 100 is disposed on the jig body 320, the pumping structure 322 can be received in the through hole 116. Each pumping structure 322 has a gas hole 324. When the first jig 100 with the keycaps 1 disposed thereon is stacked on the jig body 320, a pumping device (not shown) can draw gas from the space 15 defined by the top 11 and the skirt 13 of each keycap 1 through the gas hole 324 to reduce the gas pressure below the first film. Moreover, in one embodiment, the pumping structure 322 may have a gas channel 326 disposed on its top surface, wherein the gas channel 326 communicates with the gas hole 324 to enhance the gas-drawing effect from the space 15 under the keycap 1.

As shown in FIG. 3A, the jig cover 330 has a plurality of gas holes 332, gas grooves 324, and seal ring grooves 336, 338 to facilitate the introducing/drawing of gas to/from the pumping jig 300. For example, the gas hole 332 may include a plurality of inlet hole 332*a* disposed in the center area and a plurality of outlet holes 332*b* disposed corresponding to the periphery of the first jig 100. The gas grooves 334 are disposed in a radiant manner and communicate with the outlet holes 332*b*, respectively. As such, gas can be blown into the pumping jig 300 through the inlet holes 332*a* and drawn out through the outlet holes 332*b* to achieve the effect of pressure adjustment. Moreover, the jig cover 330 is disposed with (1) the seal ring groove 336 between the inlet holes 332*a* and the outlet holes 332*b* and (2) the seal ring groove 338 on the outer side of all outlet holes 332*b*, so that when an external gas-introducing/exhausting device (not shown) is connected to the upper surface of the jig cover 330, the seal rings of the external gas-introducing/exhausting device can be received into the seal ring grooves 336 and 338, respectively, to enhance the airtightness of the pumping device.

Figure 3D:
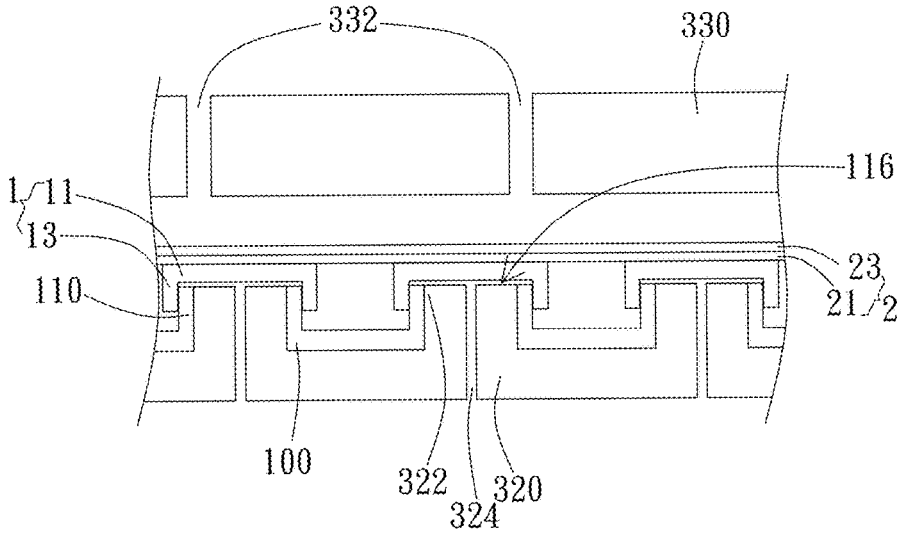
FIG. 3D is a partial enlarged schematic view of the first film covering the plurality of keycaps on the first jig together disposed in the pumping jig.
Figure 3E:
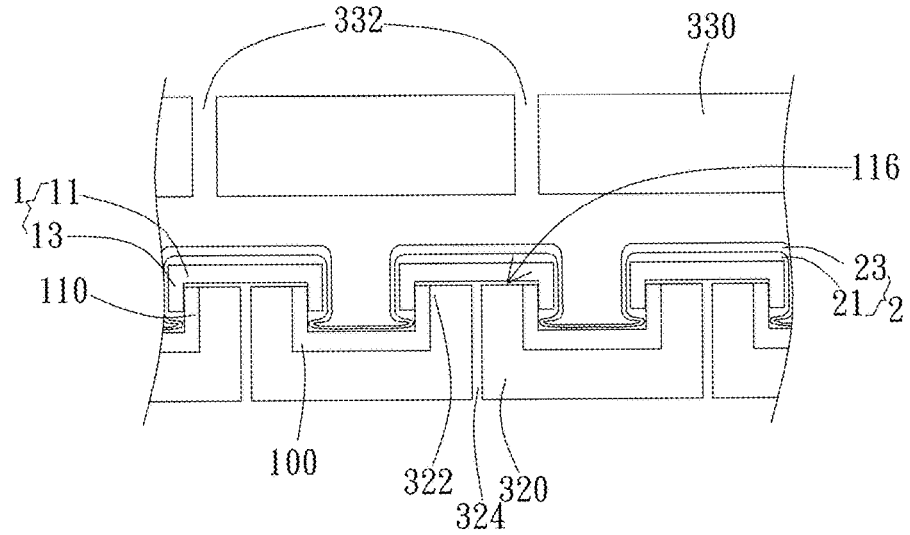
FIG. 3E is a partial enlarged view of attaching the first film onto the plurality of keycaps during the out-mold transfer.

As shown in the cross-sectional view of FIG. 3D, when the first jig 100 works with the pumping jig 300 for out-mold transferring, the plurality of keycaps 1 are disposed on the positioning units 110 of the first jig 100, respectively (as shown in FIG. 2B), and the first jig 100 is stacked on the jig body 320 that is disposed on the jig base 310 in a manner that the pumping structures 322 extend into corresponding through holes 116 of the positioning units 110. The first film 2 is disposed on the plurality of keycaps 1, and then the jig cover 330 is connected to the jig base 310 to form a sealed structure. Gas is drawn through the gas holes 324 of the pumping structures 322, or simultaneously, gas is introduced through the inlet holes 332*a* of the jig cover 330 to adjust the difference in gas pressure above the top surface and below the bottom surface of the first film 2, so that the first film 2 moves close to the space between adjacent keycaps 1 (as shown in FIG. 3E) and is transferred to cover the upper surfaces of the tops 11 and the side faces 131 of the skirts 13 of the plurality of keycaps 1. In addition, the difference in gas pressure above and below the first film 2 can be adjusted by other suitable approaches to make the first film 2 be transferred and cover the target region of the keycaps 1.

In this embodiment, the first film 2 includes an ink layer 21 and a first release layer 23, but is not limited thereto. In another embodiment, the first film 2 can further include a glue layer (not shown) as the bottommost layer to enhance the adhesion of the ink layer 21 to the keycaps 1. In other embodiments, the first film 2 can include an ink layer with glue property to enhance the adhesion of the ink layer 21 to the keycaps 1. Moreover, the first film 2 may include multiple ink layers including, for example, outer appearance ink layer, base color ink layer, etc.

Figure 4:
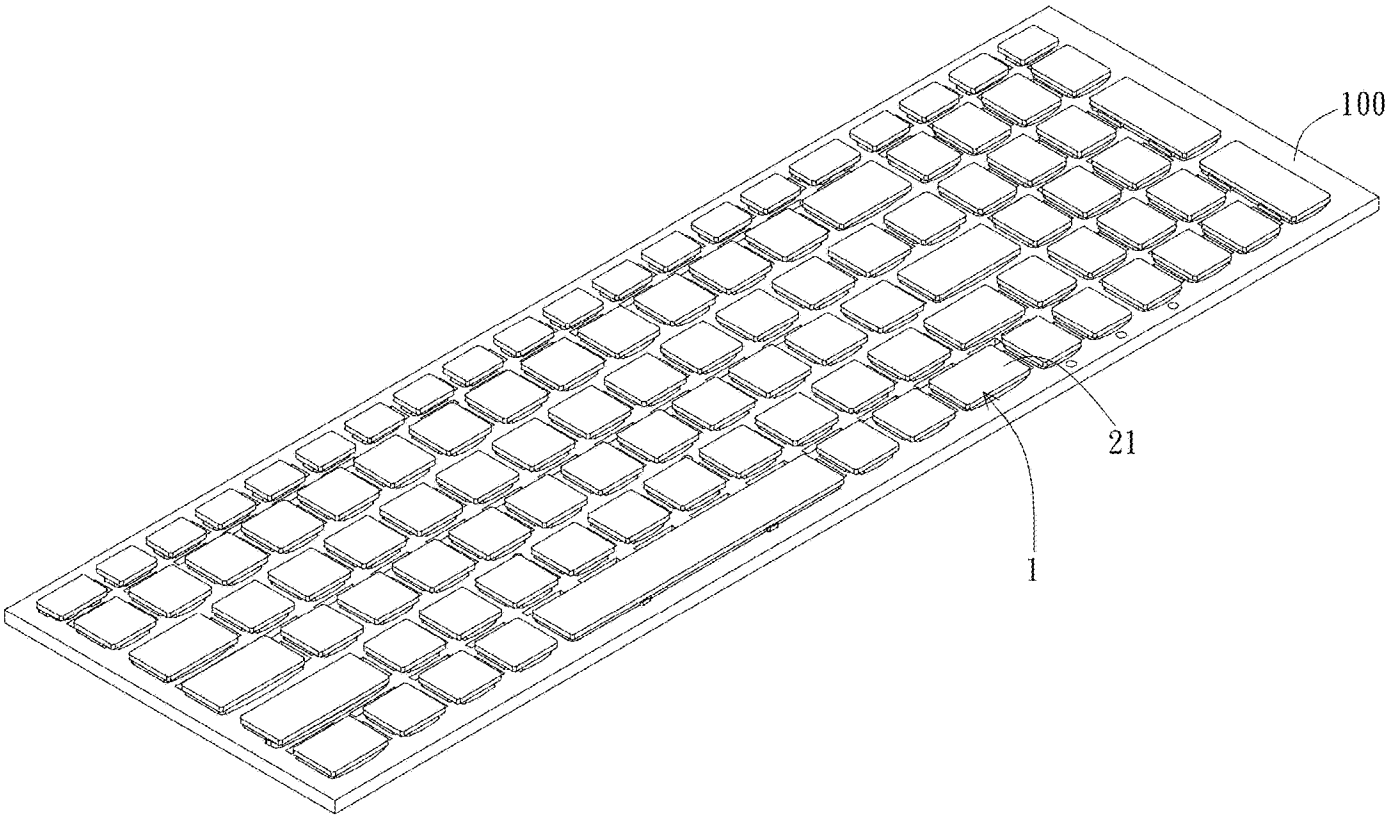
FIG. 4 is a schematic view of the ink layer attached to the plurality of keycaps arranged on the first jig.
Figure 5A:
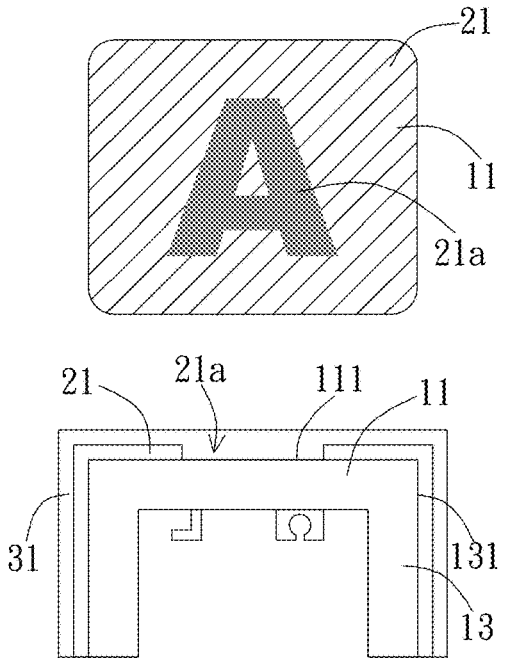
FIG. 5A is a schematic view of the keycap formed by the manufacturing method in an embodiment of the invention.

When the first film 2 covers the upper surfaces 111 of the tops 11 of the plurality of keycaps 1 and the side faces 131 of the skirts 13 of the plurality of keycaps1, the method further includes taking the firs jig 100 with the keycaps 1 out of the pumping jig 300 and removing the first release layer 23 to expose the ink layer 21, as shown in FIG. 4. Moreover, according to the corresponding character or symbol of each key, the method includes patterning the exposed ink layer to form corresponding characters or symbols 21*a* on the plurality of keycaps; and forming a protection layer 31 on the patterned ink layer 21 to protect the characters or symbols 21*a* on the plurality of keycaps 1 (the completed keycap is shown in FIG. 5A). In the keycap 1 manufactured by the method described above, the protection layer 31 has a cross section of substantial "n" shape or a cross section conformal to the "n-like" shape. It is noted, in this embodiment, the ink layer 21 is patterned by the high energy optical patterning technique, such as laser engraving, but not limited thereto. Moreover, according to design needs, the ink layer 21 may include a plurality of sub-ink layers of different colors including, for example, opaque black ink layer and light-transparent blue ink layer. By controlling the patterning power to determine the depth of ink layer to be patterned can exhibit a variety of colors in a single key to enhance the visual effect. For example, for the key with symbols of ">" and ".", (1) the black and blue ink layers are both patterned for the symbol ">", so that the symbol ">" will present the color of white of the transparent material of the keycap 1; (2) only the black ink layer is patterned and the blue ink layer remains intact for the symbol ".", so that the symbol "." will present blue light. The separation of the first release layer may result from the material property of the film, or additional releasing agent may be coated on the substrate, to achieve the effect of separating the ink layer 21 from the first release layer 23.

Furthermore, the protection layer 31 can also be formed by the out-mold transfer technique. For example, after the ink layer 21 is patterned, a second film including the protection layer 31 and a second release layer is attached onto the plurality of keycaps 1, and in the same pumping jig 300, the pressure can be adjusted as described above to make the second film cover the upper surfaces 111 of the tops 11 and the side faces 131 of the skirts 13 of the plurality of keycaps 1. Then, the second release layer is removed to expose the protection layer 31.

Figure 5B:
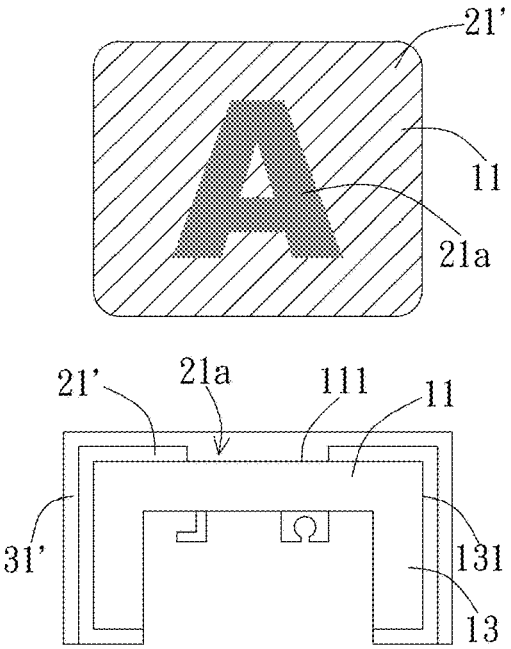
FIG. 5B is a schematic view of the keycap formed by the manufacturing method in another embodiment of the invention.

It is noted, in a preferred embodiment, the height of the positioning unit 110 protruding from the surface of the first jig 100 is associated with the length of the skirt 13 of the keycap 1 extending downward from the top 11, so that when the keycap 1 is disposed on the positioning unit 110, the bottom face 133 of the skirt 13 is preferably exposed. That is, the height of the positioning unit 110 is preferably larger than the extending length of the skirt 13 from the top 11. As such, when the keycaps 1 are disposed on the positioning units 110 of the first jig 100, the bottom faces 133 of the skirts 13 remain exposed and the first film 2 can cover the bottom faces 133 of the skirts 13 after the out-mold transfer technique is performed. Consequently, the ink layer 21' formed by such manner will be attached onto the upper surface 111 of the top 11 of the keycap 1 and the side face 131 and the bottom face 133 of the skirt 13. Similar to the above embodiment, the exposed ink layer 21' is patterned to form the corresponding character or symbol, and then, the protection layer 31' is formed on the patterned ink layer 21' to protect the character or symbol (the completed keycap is shown in FIG. 5B). By such a design, when the first release layer 23 is removed, the release layer 23 is firstly removed from the bottom face 133 of the skirt 13, preventing damage of the ink layer 21' on the side face 131 of the skirt 13 that usually occurs when the first release layer is firstly removed from the side face 131 of the skirt 13. Therefore, the outer appearance of the keycap 1 can be promoted, and the possibility of light leakage from the skirt 13 of the keycap 1 of the lighting keyboard due to damage of the ink layer 21 can be reduced.

Figure 6A:
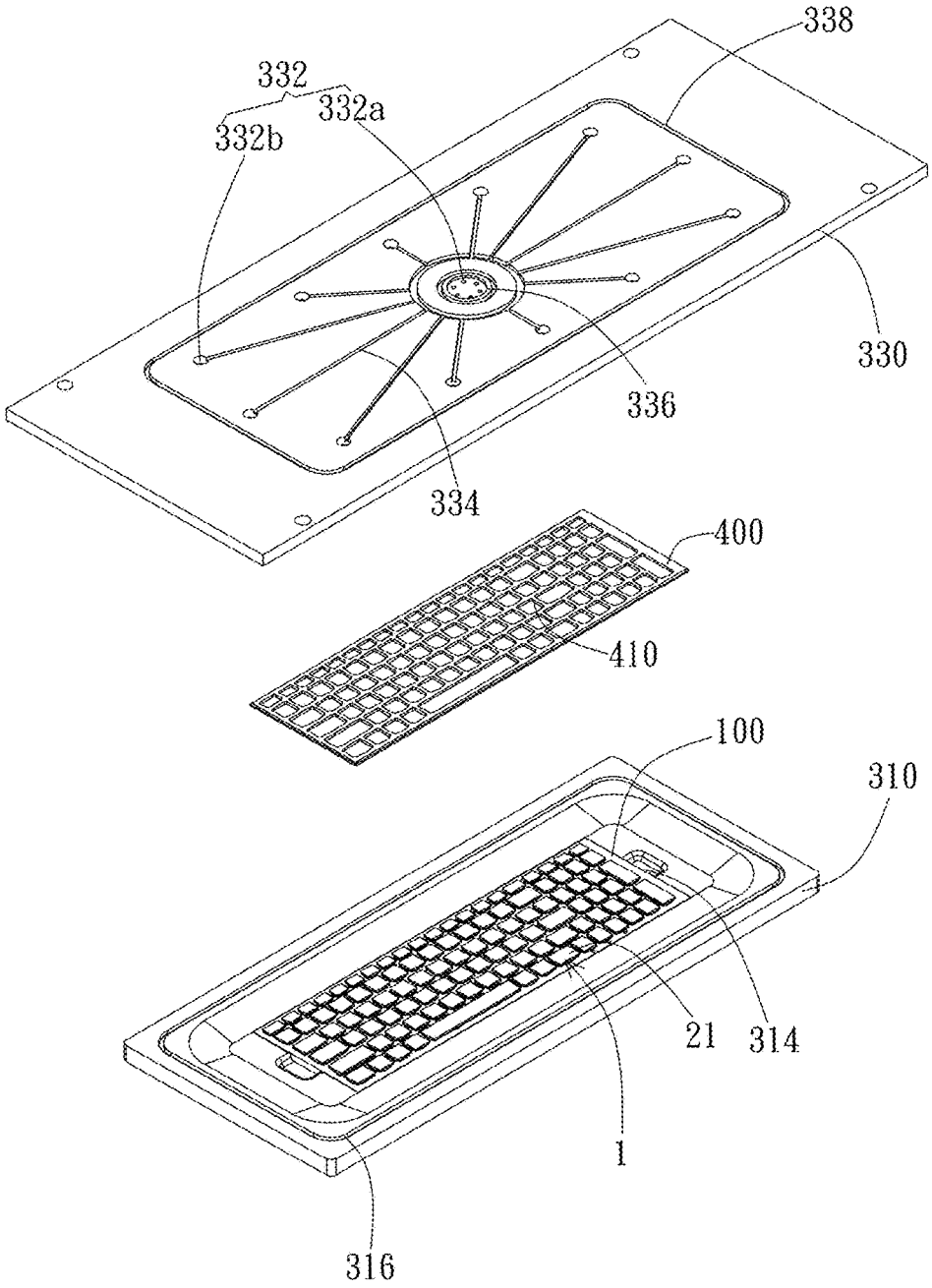
FIGS. 6A and 6B are respectively a schematic view and a partial enlarged view of the protection layer formed by using the third jig.
Figure 6B:
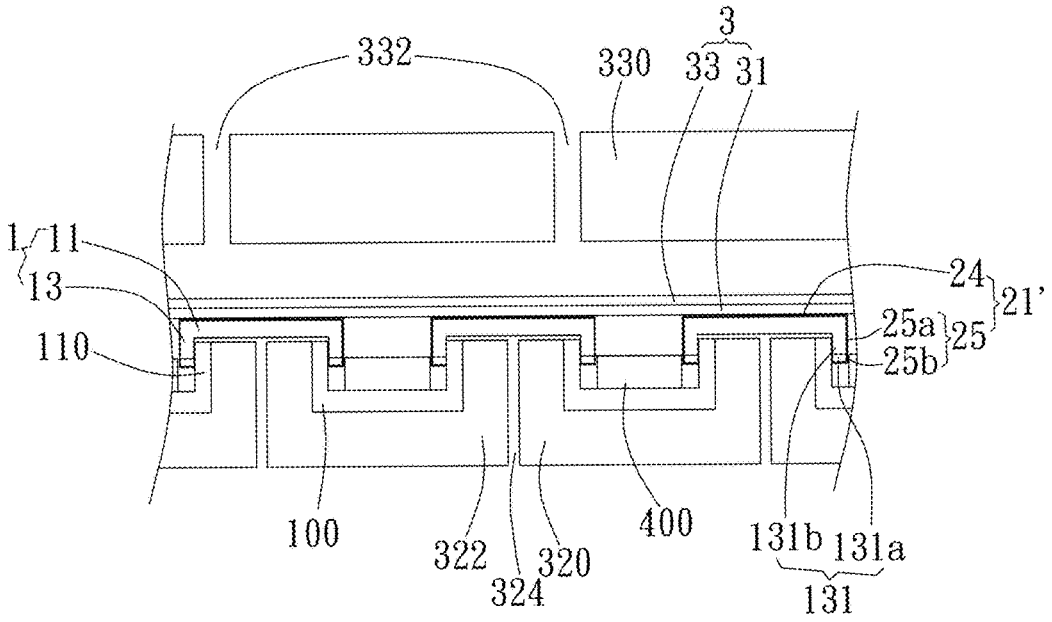

Furthermore, the method of the present invention can employ an additional jig to form the protection layer or the ink layer of different shape. As shown in FIG. 6A and FIG. 6B, in another embodiment, before the formation of the protection layer, a third jig 400 is provided, wherein the third jig 400 includes a plurality of receiving spaces 410 and the third jig 400 has a predetermined thickness. The plurality of receiving spaces 410 respectively correspond to the plurality of positioning units 110, and the predetermined thickness of the third jig 400 is less than the height of the skirt 13. For example, the third jig 400 has a plurality of through holes serving as the receiving spaces 410, wherein the diameter and the shape of the through holes correspond to those of the plurality of positioning units 110, respectively. Then, the third jig 400 is stacked on the first jig 100; the receiving spaces 410 in the form of through holes allow the positioning units 110 with the keycaps 1 disposed thereon to be received therein, so that the third jig 400 of predetermined thickness masks a portion of the side face 131 of the skirt 13 of each keycap 1. By the out-mold transfer technique, the second film 3 is attached onto the plurality of keycaps 1 in a manner that the second film 3 including the protection layer 31" and the second release layer 33 covers surfaces 111 of the tops 11 and a portion of the side faces 131 of the skirts 13 of the plurality of keycaps 1 that are not masked by the third jig 400. After that, the second release layer 33 is removed to expose the protection layer 31".

Figure 6C:
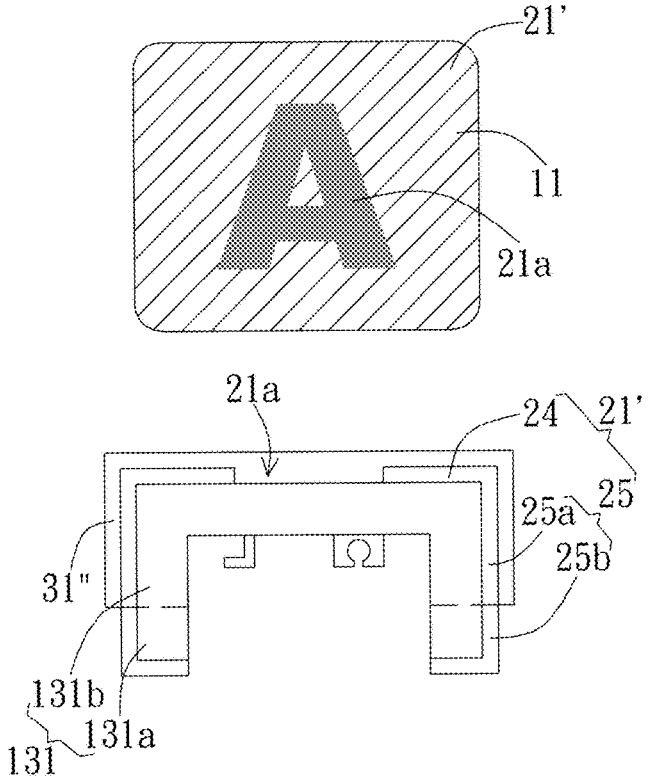
FIG. 6C is a schematic view of the keycap formed by the manufacturing method in yet another embodiment of the invention.

In other words, as shown in FIG. 6C, the ink layer 21' on the keycap 1 includes an upper ink portion 24 and a side ink portion 25, wherein the upper ink portion 24 is disposed on the upper surface 111 of the top 11, and the side ink portion 25 is disposed on the side face 131 of the skirt 13. The side ink portion 25 further includes an upper section 25*a* and a lower section 25*b*. In this embodiment, by means of the third jig 400 of predetermined thickness masking the ink layer on the lower portion 131*a* of the side face 131 of the skirt 13 (i.e. the lower section 25*b* of the side ink portion 25) and exposing the ink layer on the upper portion 131*b* of the side face 131 of the skirt 13 (i.e. the upper section 25*a* of the side ink portion 25), the protection layer 31" formed by the out-mold transfer technique will cover the upper ink portion 24 and the upper section 25*a* of the side ink portion 25, and the lower section 25*b* of the side ink portion 25 remains exposed, thus saving the material of the protection layer and reducing the cost as well as preventing the reduction in yield due to the limitation of material property of the protection layer as the lower section 25*b* of the side ink portion 25 is to be covered by the protection layer. It is noted that the predetermined thickness of the third jig 400 is preferably designed to expose the interface where the top 11 and the skirt 13 are connected, so the protection layer 31" can not only cover the upper ink portion 24 on the upper surface 111 of the top 11, but also extend over the interface where the top 11 and the skirt 13 are connected to cover the upper portion 131*b* of the side face 131 of the skirt 13. The keycap with such design of protection layer can prevent the unevenness touch feeling during operation, increasing the smoothness of operation.

Figure 7A:
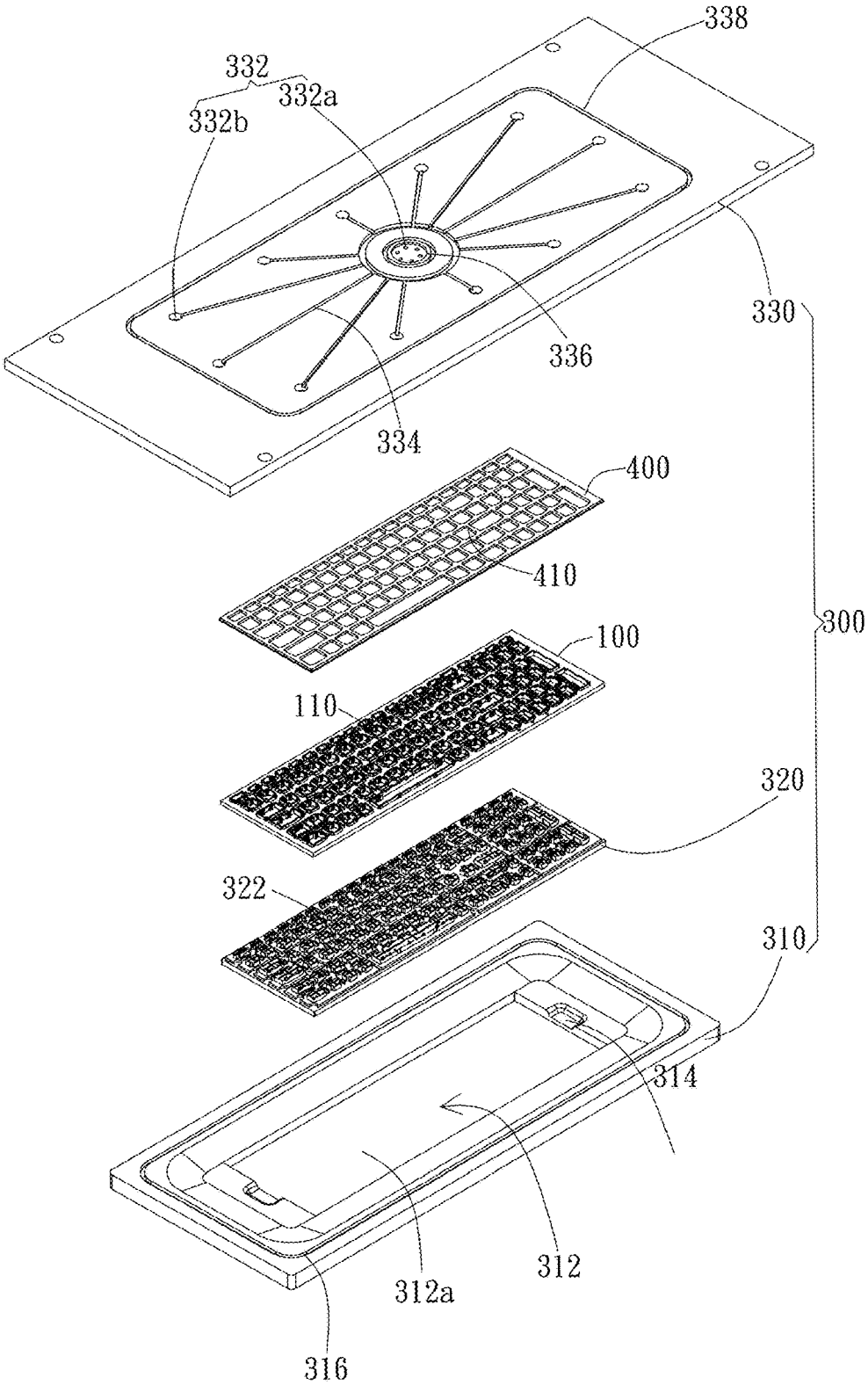
FIG. 7A is a schematic view of the first jig, the third jig, and the pumping jig used in another embodiment of the invention.

In another embodiment, as shown in FIG. 7A, before the formation of the ink layer, the third jig 400 is provided to form the ink layer of different shape. As described above, the third jig 400 includes a plurality of through holes to serve as the receiving spaces 410, and the diameter and the shape of the through holes correspond to those of the plurality of positioning units 110, respectively. Then, the third jig 400 is disposed on the first jig 100; the receiving spaces 410 in the form of through holes allow the positioning units 110 with the keycaps 1 disposed thereon to be received therein, so that the third jig 400 of predetermined thickness masks a portion of the side face 131 of the skirt 13 of each keycap 1. By the out-mold transfer technique, the first film 2 is attached onto the plurality of keycaps 1 in a manner that the first film 2 including the ink layer 21 and the first release layer 23 covers the upper surfaces 111 of the tops 11 and a portion of the side faces 131 of the skirts 13 of the plurality of keycaps 1 that are not masked by the third jig 400. After that, the first release layer 23 is removed to expose the protection layer 21".

Figure 7B:
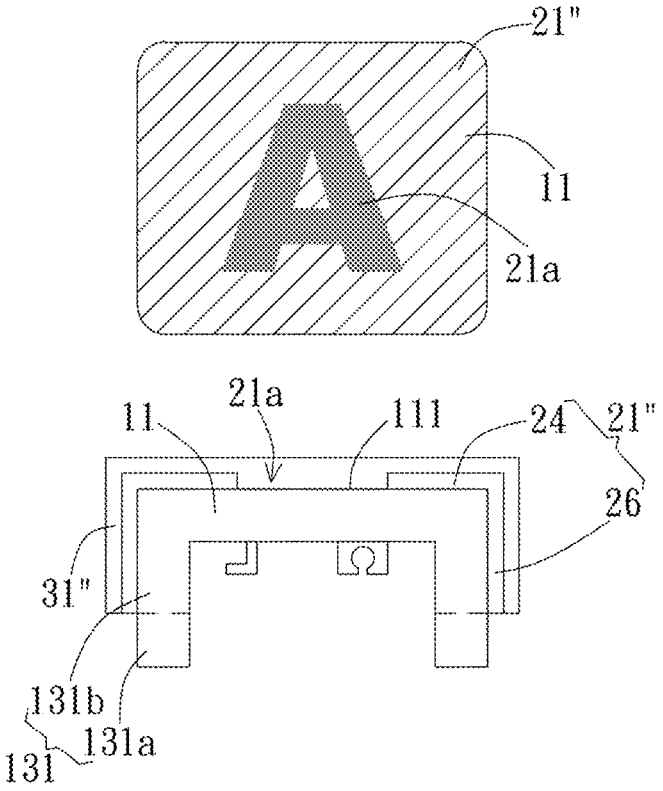
FIG. 7B is a schematic view of the keycap formed by the manufacturing method in another embodiment of the invention.

In other words, as shown in FIG. 7B, the side face 131 of the skirt 13 includes the upper portion 131*b* and the lower portion 131*a*. In this embodiment, by means of the third jig 400 of predetermined thickness masking the lower portion 131*a* of the side face 131 of the skirt 13 and exposing the upper portion 131*b* of the side face 131 of the skirt 13, the ink layer 21" formed by the out-mold transfer technique includes an upper ink portion 24 on the upper surface 111 of the top 11 and a side ink portion 26 on the upper portion 131*b* of the side face 131 of the skirt 13, leaving the lower portion 131*a* of the side face 131 of the skirt 13 exposed without ink layer covering thereon. After the first release layer 23 is removed, also by means of the third jig 400 of predetermined thickness masking the lower portion 131*a* of the side face 131 of the skirt 13 and exposing the side ink portion 26 on the upper portion 131*b* of the side face 131 of the skirt 13, the protection layer 31" formed by the out-mold transfer technique will cover the upper ink portion 24 and the side ink portion 26, leaving the lower portion 131*a* of the side face 131 of the skirt 13 exposed. The keycap with the lower portion 131*a* of the side face 131 of the skirt 13 exposed is suitable for non-lighting keyboard which has no concern with the light leakage from the skirt 13, and the outer appearance of the keycap 1 to the user exhibits that the upper surface 111 of the top 11 and the upper portion 131*b* of the skirt 13 are covered by the black ink layer, without impairing the aesthetic feeling or perception. Consequently, materials of the ink layer and the protection layer can be saved to lower the cost, and the production yield can be increased due to the smaller covering area of the skirt 13.

It is noted, in the embodiments, the protection layer 31, 31', 31" can have a convex-concave texture, a nanostructure or an optical structure with specific physical or chemical property (such as hydrophobic property or dirt-resistant property) to maintain the cleanness of the keyswitch that prolongs the life of the keyswitch.

Figure 8A:
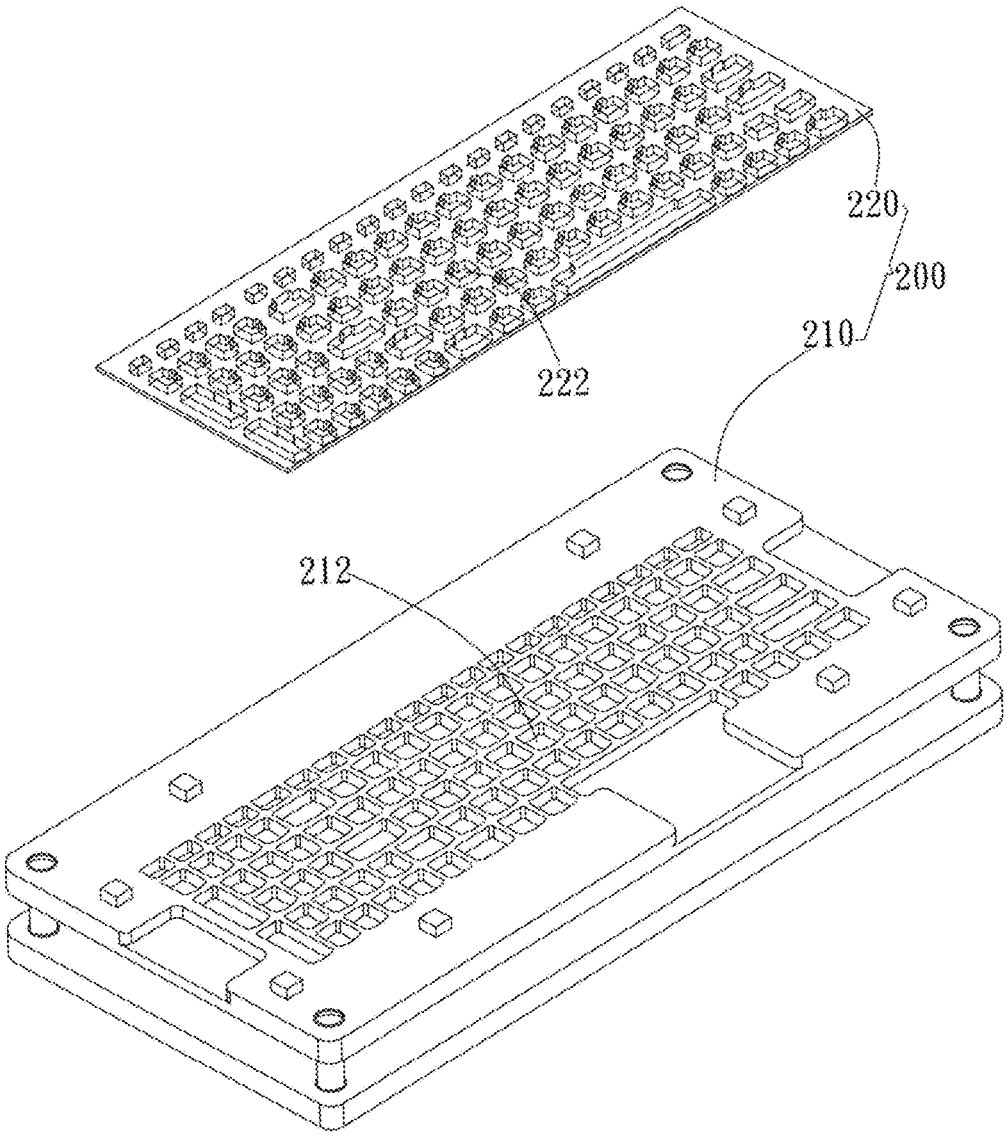
FIG. 8A is a schematic view of the second jig used in an embodiment of the invention.

In addition, after the keycaps formed by the methods described in the embodiments, the process of transferring the keycaps can be performed to facilitate the assembly with other components of the keyswitch (such as the up/down mechanism). In an embodiment, the method of the present invention further includes providing a second jig 200 (as shown in FIG. 8A), wherein the second jig 200 includes a receiving part 210 and a pushing part 220. The receiving part 210 has a plurality of receiving spaces 212 respectively corresponding to the plurality of positioning units 110 of the first jig 100. Particularly, the size, location, shape, etc. of the receiving spaces 212 of the receiving part 210 correspond to those of the keycaps 1 on the positioning units 110, respectively, so that the keycaps 1 can be received in the receiving spaces 212. The pushing part 220 has a plurality of protrusion portions 222 for pushing the keycaps 1 out of the positioning units 110 of the first jig 100 to be received in the receiving spaces 212 of the second jig 200.

Figure 8B:
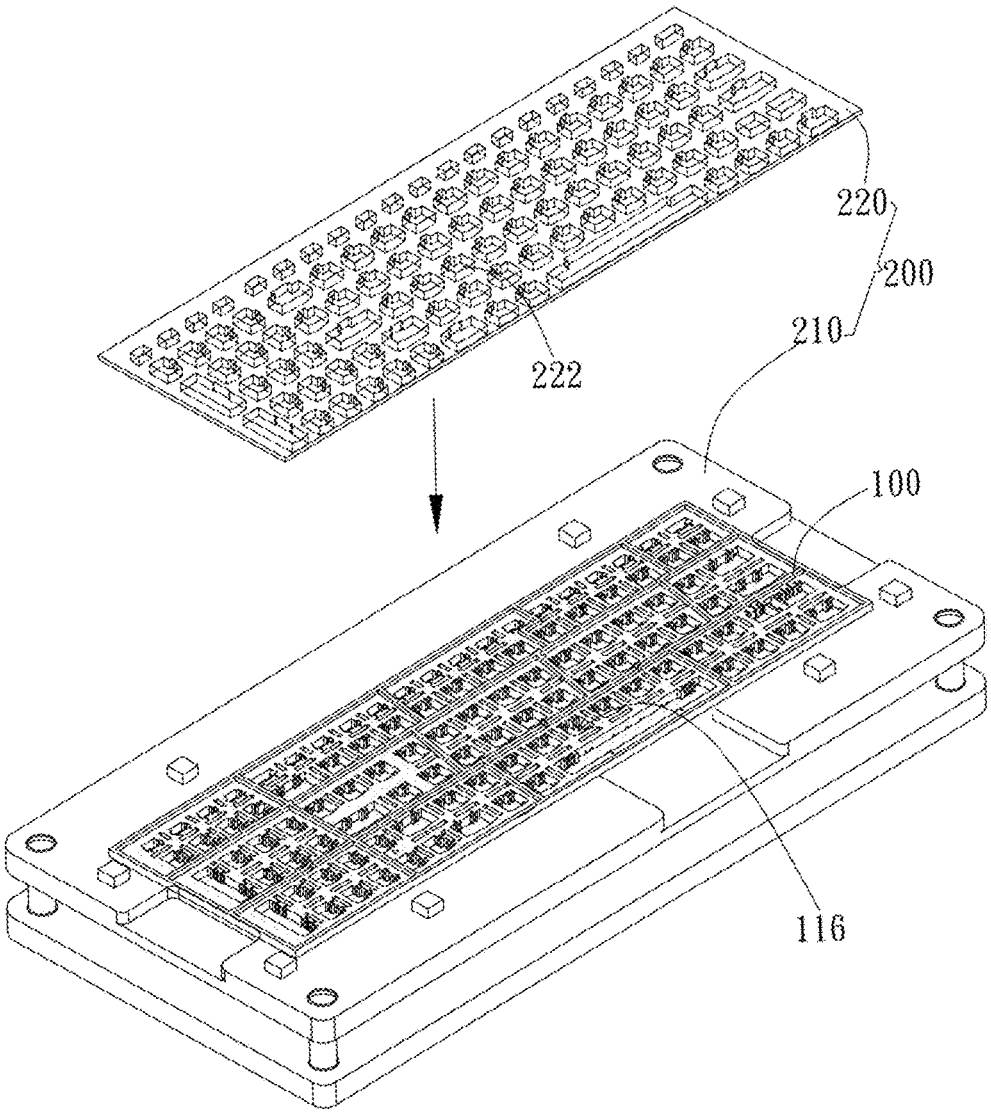
FIGS. 8B and 8C are respectively a schematic view and a partial enlarged view of the keycaps being transferring from the first jig to the second jig in an embodiment of the invention.
Figure 8C:
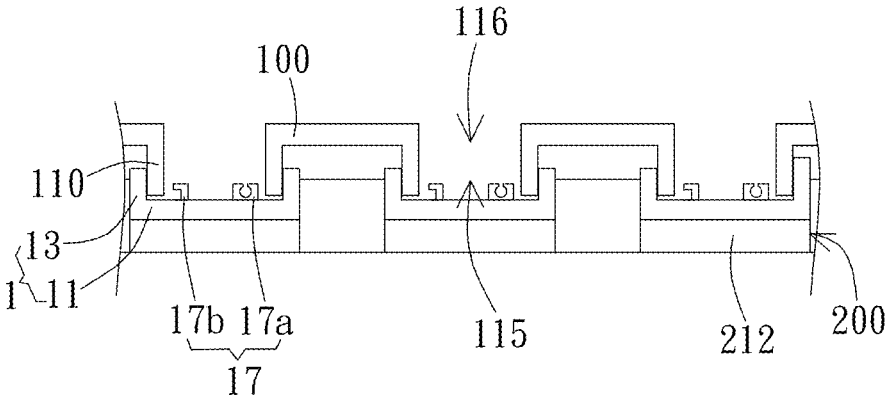
Figure 8D:
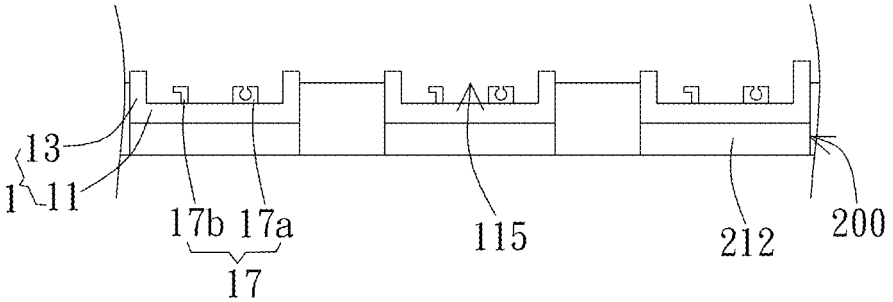
FIG. 8D is a partial enlarged view of the keycap transferred to the second jig.

Therefore, after the second jig 200 is provided, as shown in FIG. 8B and FIG. 8C, the method further includes flipping the first jig 100 with the keycaps 1 disposed thereon to make the tops 11 of the keycaps 1 face the second jig 200, i.e. the receiving part 210. Then, the tops 11 of the plurality of keycaps 1 are aligned with the plurality of receiving spaces 212, respectively. By means of the pushing part 220, a downward force is applied to the plurality of keycaps 1 to push the keycaps 1 from the positioning units 110 of the first jig 100 toward the receiving spaces 212 of the receiving part 210, so that the plurality of keycaps 1 can be removed from the plurality of positioning units 110 and positioned in the receiving spaces 212, respectively. In other words, the protrusion portion 222 of the pushing part 220 extends into the through hole 116 of the corresponding positioning unit 110 from the backside of the first jig 100 and exerts force to detach the engaging portions 17*a*, 17*b* of the keycap 1 from the connection members 112, 114 and further to move the keycap 1 toward the receiving space 212 of the receiving part 210. Consequently, the keycaps 1 are removed from the first jig 100 and transferred to the receiving spaces 212. As shown in FIG. 8D, after the transfer, the first jig 100 is removed, and the top 11 of the keycap 1 faces the inner side of the receiving space 212 while the space 15 defined by the top 11 and the skirt 13 and the engaging portions 17 of the keycap1 are exposed to facilitate the subsequent assembly process of keyboard.

Although the preferred embodiments of the present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A keycap, comprising:

a top having an upper surface;

a skirt surroundingly connected to at least a portion of periphery of the top, the skirt extending downward from the top along an extending direction, the skirt having a side face;

an ink layer for forming character or symbol, the ink layer comprising an upper ink portion on the upper surface of the top and a side ink portion on the side face of the skirt, the side ink portion comprising an upper section and a lower section; and a protection layer formed only on the upper ink portion and the upper section of the side ink portion to expose the lower section of the side ink portion along the extending direction of the skirt.

2. A keycap, comprising:

a top having an upper surface;

a skirt surroundingly connected to at least a portion of periphery of the top, the skirt having a side face and a bottom face, the bottom face and the upper surface facing opposite directions;

an ink layer formed on the upper surface of the top and the side face and the bottom face of the skirt; and a protection layer formed on the ink layer.

3. The keycap of claim 2, wherein the protection layer is formed only on the upper surface of the top and an upper portion of the side face of the skirt.

4. The keycap of claim 1, wherein the side face of the skirt is a quadrilateral; the boundary of the upper section and the lower section of the side ink portion is substantially a straight line extending horizontally.

5. A method of manufacturing a keycap, the method comprising:

forming an injection-molded keycap having a top and a skirt surroundingly connected to at least a portion of periphery of the top, the top having an upper surface, the skirt having a side face;

providing a first jig having a positioning unit;

arranging the injection-molded keycap onto the positioning unit to engage an underside of the injection-molded keycap with the positioning unit;

covering at least the upper surface and the side surface of the injection-molded keycap with a first film comprising an ink layer and a first release layer;

softening the first film such that the ink layer adheres to the upper surface and the side face;

removing the first release layer to expose the ink layer on the upper surface and the side face;

forming a protection layer on the ink layer on the upper surface to protect the character or symbol on the injection-molded keycap, so as to form the keycap; and removing the keycap from the positioning unit.

6. The keycap of claim 5, wherein the ink layer completely covers the side face of the skirt.

7. The keycap of claim 5, wherein the ink layer extends from a lower edge of the side face of the skirt to a bottom face of the skirt, so a portion of the ink layer is under the skirt.

8. The method of claim 5, further comprising patterning the ink layer to form a character or symbol on the injection-molded keycap before forming the protection layer.

9. The method of claim 5, before forming the protection layer, the method further comprising:

providing an additional jig including a receiving space corresponding to the positioning unit; and stacking the additional jig on the first jig, the jig having a predetermined thickness less than a height of the skirt, such that the additional jig masks a portion of the side face of the skirt, and the protection layer is formed only on the upper surface of the top and an unmasked portion of the side face of the skirt after the protection layer is formed.

10. The method of claim 5, wherein the step of removing the keycap from the positioning unit comprises:

providing a second jig including a receiving part and a pushing part, the receiving part having a receiving space corresponding to the positioning unit, the pushing part having a protrusion portion;

arranging the first jig on the receiving part with the keycap facing the receiving part such that the keycap is aligned with the receiving space; and pushing the keycap out of the positioning unit of the first jig by using the protrusion portion of the pushing part, such that the keycap is transferred to the receiving space of the receiving part.

* * * * *